United States Patent [19]

Barrera et al.

[11] 4,373,674

[45] Feb. 15, 1983

[54] CRUSHING METHOD AND APPARATUS

[76] Inventors: Marion Barrera, P.O. Box 185, Fort Thomas, Ariz. 85536; Raymond Godfrey, 617 3rd St., Safford, Ariz. 85546

[21] Appl. No.: 178,957

[22] Filed: Aug. 18, 1980

Related U.S. Application Data

[63] Continuation-in-part of Ser. No. 12,022, Feb. 14, 1979, abandoned.

[51] Int. Cl.[3] ..... B02C 19/08; B02C 1/00

[52] U.S. Cl. ..... 241/15; 241/30; 241/38; 241/169.2; 241/218; 241/266; 241/284

[58] Field of Search ..... 241/15, 30, 38, 169, 241/169.2, 175, 199.9, 199.11, 201, 217, 218, 219, 264, 266, 267, 283, 284

[56] References Cited

U.S. PATENT DOCUMENTS

| | | | |
|---|---|---|---|
| 2,440,051 | 4/1948 | Lind | 241/38 X |
| 2,463,843 | 3/1949 | Wright | 241/38 |
| 2,525,867 | 10/1950 | Cooper | 241/199.9 |
| 3,154,257 | 10/1964 | Wootten | 241/283 X |
| 3,645,458 | 2/1972 | Tobe | 241/175 |
| 3,762,659 | 10/1973 | Aegidius | 241/283 X |
| 3,840,191 | 10/1974 | Herzog | 241/283 X |
| 3,865,551 | 2/1975 | Saiki et al. | 241/199.11 X |

*Primary Examiner*—Howard N. Goldberg
*Attorney, Agent, or Firm*—Gregory J. Nelson

[57] ABSTRACT

A rock and ore pulverizer or crusher device having a generally cylindrical elongate mortar defining a crushing chamber. The mortar is rockable or oscillable by means of a cradle which is driven through an eccentric drive apparatus. A generally cylindrical elongate pestle is secured within the mortar and independently retained therein by a flexible cable and swivel arrangement. The head end of the pestle is preferably tapered and provided with grooves to retain the material fed into the device. The entire device is installed at a desired inclination and material is introduced into a feed trough ahead of the pestle to be crushed as the material moves along the pestle and relative motion is imparted between.

12 Claims, 9 Drawing Figures

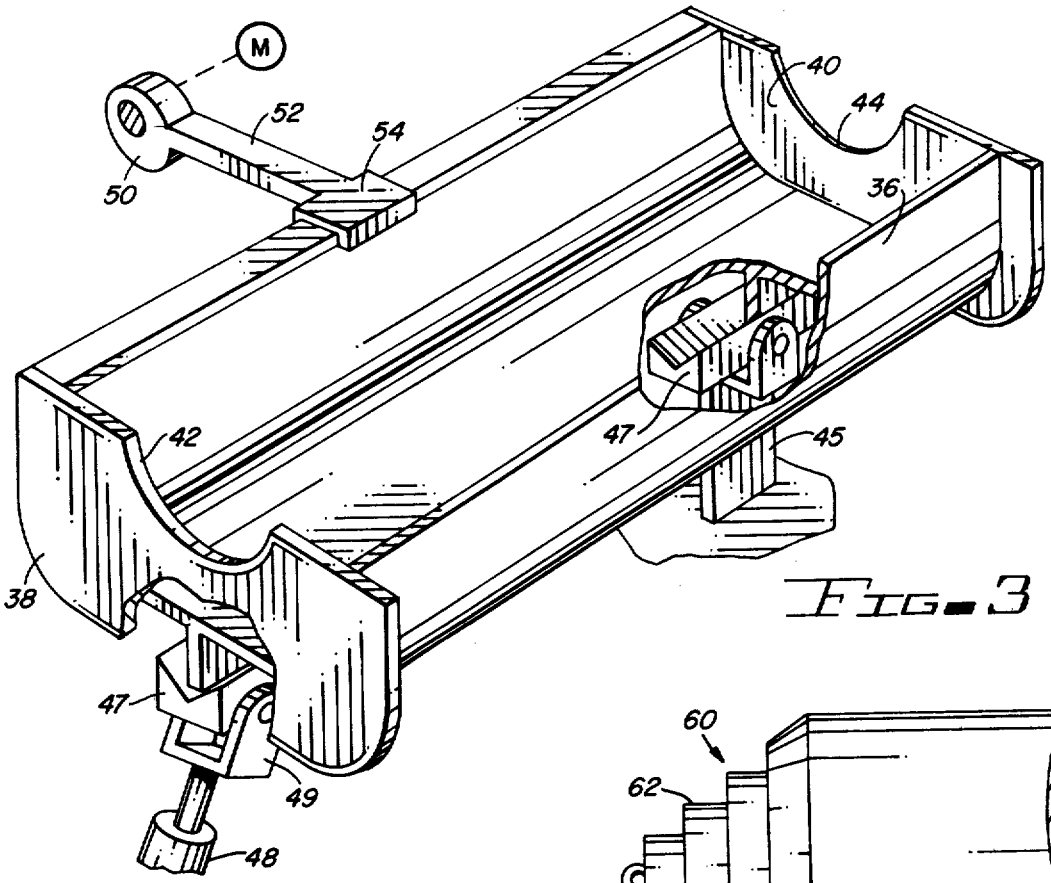
FIG. 3
FIG. 4
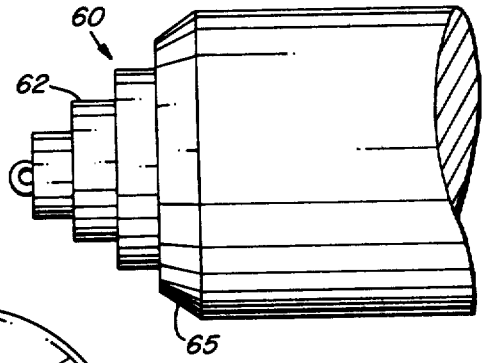
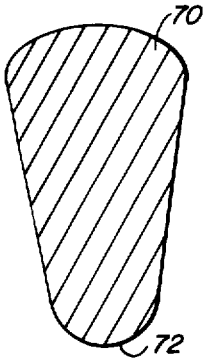
FIG. 6
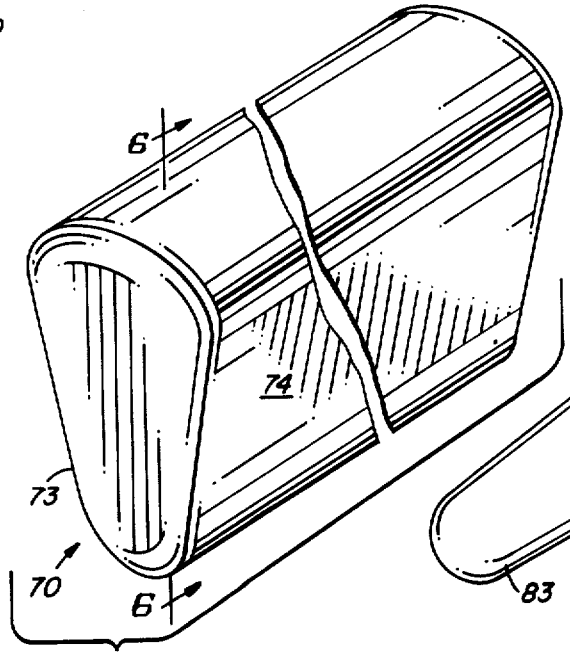
FIG. 5
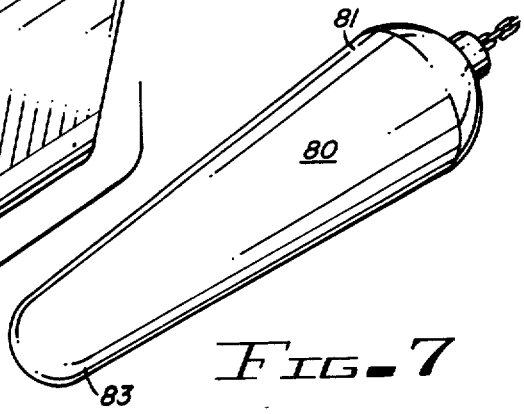
FIG. 7

CRUSHING METHOD AND APPARATUS

The present application is a continuation-in-part of co-pending application, Ser. No. 012,022 entitled "Apparatus For Crushing and/or Pulverizing Substances" filed Feb. 14, 1979, now abandoned.

The present invention relates to a crushing device and more particularly relates to a device for crushing or pulverizing materials such as rock, ore and other substances to a reduced size.

Crushing of materials such as rock, ore and other materials is generally accomplished by processing the material in a series of machines such as a gyratory crusher, jaw crusher or the like in the primary stage and subjecting the material to a secondary crushing in ball mills, rod mills, disc pulverizers and the like to achieve the desired mesh size. A number of problems are encountered in crushing ores using machines of conventional design and such conventional means are deficient in the following manner:

A. Conventional processes often require several crushers in series in order to obtain proper sizing before entering the final state which requires a different type of machine to obtain the desired mesh size.

B. Conventional machines require constant attention and observation during operation.

C. Conventional machines and processes often contaminate finely crushed or pulverized materials with foreign material such as iron.

D. Conventional machines and devices require periodic stopping because of clogging or the need of cleaning or resurfacing of the machine or machine surfaces.

E. Conventional machines and processes have difficulty in producing mesh sizes of 100 or better; and F. Conventional machines are expensive in first costs and require expensive maintenance procedures.

Accordingly, there exists a need in the art for an apparatus for crushing substances to a desired mesh which avoids the problems attendant with prior art machines.

The present invention relates generally to an improved device for crushing or pulverizing substances which accomplishes crushing to a fine mesh size in an efficient, quick and simple manner requiring substantially less horsepower to achieve comparable results as compared with conventional machines. The device of the present invention includes a generally cylindrical housing or mortar which defines a crushing chamber. The mortar is rocked or moved in an oscillatory motion by an eccentric drive device. Located within the mortar is a generally cylindrical pestle having a conical or tapered forward end. A feed trough directs the material to be crushed to the head end of the pestle. The pestle is freely suspended independently of the mortar through a universal connection by a chain secured to a steel plate. The head end of the pestle is appropriately grooved or stepped and the mortar and pestle are installed at an angle so material will flow by gravity from the feed trough along the pestle to the discharge end of the mortar. The mortar is rocked through an eccentric drive and pieces of material are received at the head end of the pestle and are caught between the mortar and the tapered grooved end of the pestle and further reduced as the material passes along the pestle in the crushing chamber. The mesh size can be further controlled by using a stream of water or liquid directed to the area between the mortar and pestle.

The apparatus of the present invention can be made in various sizes to accomodate the size of the substance or material to be crushed. The apparatus of the present invention can be used with other similar apparatus in series. Once adjusted, the machine will operate with a minimum of attention and maintenance. The amount of foreign matter added to the substance crushed is also less than compared with conventional machines. The mesh size achieved partially depends on the length of the pestle and crushing chamber and the weight of the pestle, and accordingly the device can be adjusted to produce extremely fine, pulverized material at the discharge.

As pointed out above, conventional devices such as ball and rod mills often used by mining companies produce mesh size of 25 to finer and are expensive at first costs. The pulverizer device of the present invention will produce particle mesh size to 100 mesh or finer at less cost and should require substantially less maintenance than conventional ball and rod mills or gyratory crushers which require constant maintenance and replacement of or rejuvenation of crushing surfaces.

The above and other objects and advantages of the present invention will be more fully understood from the following description, claims and drawings in which:

FIG. 3 is a perspective view of the rocking mechanism;

FIG. 4 is a detail view of an alternate form of the pestle head;

FIG. 5 is a perspective view showing still another form of the pestle body;

FIG. 6 is a sectional view taken along lines 6—6 of FIG. 5;

FIG. 7 is a perspective view showing still another form of the pestle body.

Figure 1:
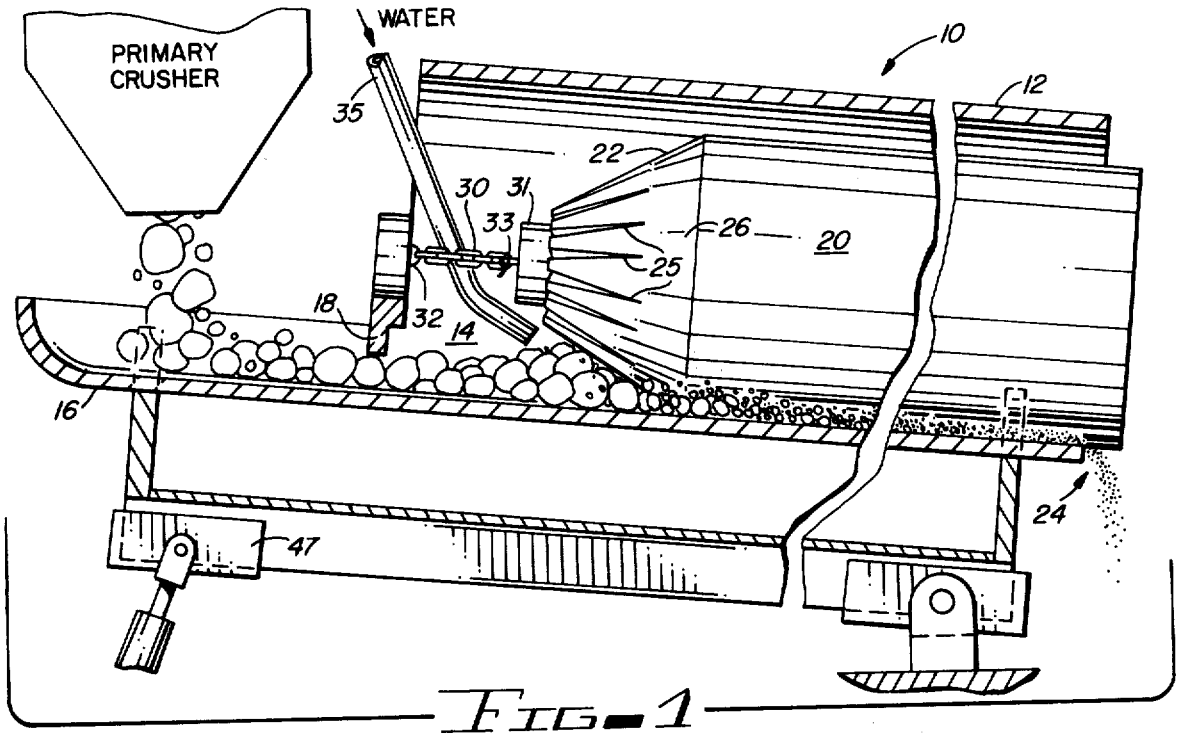
FIG. 1 is a longitudinal sectional view of the crusher apparatus of the present invention.
Figure 2:
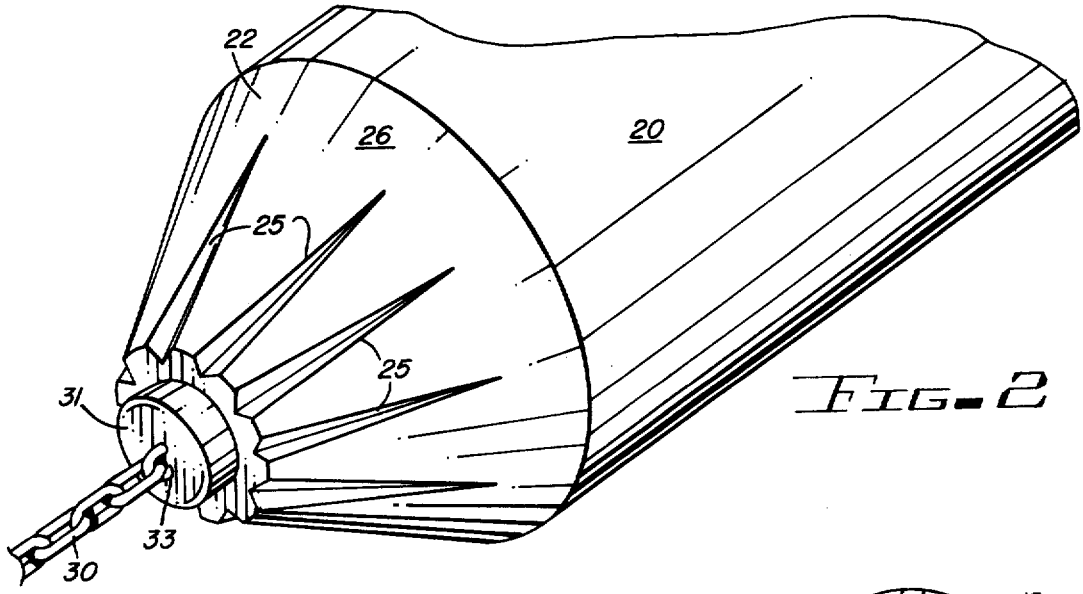
FIG. 2 is a perspective view of the head end of the pestle.

Turning now to the drawings, particularly FIGS. 1 to 3, the crusher and pulverizer device of the present invention is generally designated by the numeral 10 and includes an elongate, generally cylindrical mortar 12 which defines an interior crushing chamber 14. The forward end of the mortar defines an elongate feed trough 16 which receives material to be crushed. A gate or feed plate 18 extends transversely across the feed trough ahead of the crushing chamber 14 to provide a point of attachment for chain 30 holding the pestle in place. Material delivered to the feed trough will be subjected to a primary crushing operation by means of a gyratory crusher or similar device as it is essential that the rock sizing be less than the clearance between the lower end of plate 18 and the feed trough or clogging will occur.

The interior surfaces of the mortar may be formed of an appropriate armored steel, or hardened steel plate, particularly at areas where highest degree of wear occur. Pestle 20 is housed within the crushing chamber 14 and is shown as being generally elongate and cylindrical in cross section having a head end 22 which is tapered and is shown as a truncated cone. Pestle 20 can be similarly made of hardened steel for wear-resistance and may be in some instances hollow and filled with an appropriate solid, liquid or gas in order to regulate the weight of the pestle. The mortar and pestle can be made of any convenient size consistent with the size of the material being crushed or pulverized.

As best seen in FIG. 1, the pestle extends axially beyond the discharge end 24 of the mortar to prevent a wear or groove ridge which may develop due to the relative motion between the mortar and pestle.

The head end 22 of the pestle is provided with a plurality of grooves 25 in the outer surface of the taper. Preferably, as shown in FIGS. 1 and 2, the grooves extend only partway along the taper leaving an area 26 peripherally around the tapered portion which is devoid of grooves which might otherwise hinder the crushing process. Further, as shown in FIG. 2, grooves 25 are rearwardly inclined having the maximum depth of their forward end and decreasing in depth rearwardly until the tapered surface of the pestle is intersected.

The tapering is of a desired degree to accomodate the substance being crushed. The degree of tapering between 25° and 45° appear to work most satisfactorily for most materials such as rock or ore but other taper angles could be used in some applications. The length of the tapers also depends on the size and type of the substance being crushed and the weight and size of the pestle. Excessive taper at the head end of the pestle may cause the front end of the pestle to lift as will excessively rapid feed, resulting in a loss of efficiency in the machine. The tapered section at the head end of the pestle aids in breaking the large pieces of material into smaller substances. The grooves help to grip the parts so that they will not tend to slip or be forced toward the feed trough. For best results, the ratio of the outside diameter of the pestle to the inside diameter of the mortar should be approximately 9:10 or so.

FIG. 2 illustrates groove 25 which has opposite walls intersecting at approximately a 60° angle. This type of grooving serves two purposes as the grooves will help in preventing wedging of a piece of material in the groove and, if wedging does occur, removal is easier. The grooves can be of varying depth and at angles preferably ranging from 60° to 90° and may be formed as a plurality of serrations.

The forward end of the pestle is provided with a rotative swivel 31 connected to a flexible cable or chain 30 at latch hook 33. The chain retains the pestle and enables the pestle to be removed for checking. The opposite end of chain 20 is attached to a ring 32 fixed to the upper end of gate plate 18 which aligns with the axial center of the pestle.

One or more conduits 35 are directed to discharge in the crushing chamber 14 at the head of the pestle. The conduits may deliver a controlled stream of water, gas or other liquid to assist in achieving the desired mesh size of the substance being crushed.

The rocker mechanism is best shown in FIG. 3 and includes an elongate U-shaped body or cradle 36 having opposite end walls 38 and 40. End wall 38 is provided with a semi-circular cut-out 42 and similarly end wall 40 is provided with a semi-circular cut-out 44 which accomodates mortar 12. Mortar 12 can be welded or otherwise bolted to the rocker assembly. The longitudinally extending fulcrum 45 is provided on the bottom side of bottom member 36. Rocking motion is imparted through an eccentric 50 which includes eccentric arm 52 secured to body 36 at bracket 54. Eccentric 50 is driven by an appropriate prime mover, not shown. The entire rocker mechanism can be tilted by hydraulic actuator 48 connected at U-shaped bracket 49 to grooved plate 47 within which fulcrum 45 rests. Tilting of the mechanism allows the user to regulate the flow by gravity toward the discharge end.

Figure 8A:
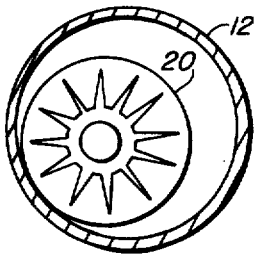
FIGS. 8A and 8B are views of the mortar and pestle showing a crushing occurs between the mortar and pestle.
Figure 8B:
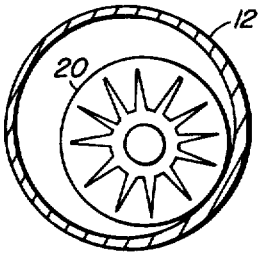

The present invention will be better understood from the following description of operation. The entire crushing and pulverizing unit 10 is constructed as described above and installed at a desired angle of inclination. Ten to twenty degrees of inclination has been found to be acceptable. The entire unit is inclinable by a hydraulic jack 48 to the desired tilt. The mortar 12, with the pestle inside may be welded or bolted to the fulcrum cradle 36 and the rocking will be initiated upon actuation of the eccentric 50. The rocking of the fulcrum cradle will induce relative movement between the mortar 12 and pestle 20. The speed and length of rolling of the pestle within the mortar should be controlled within limits to prevent "bounce". Material introduced into the crushing chamber 14 through the feed trough 16 will encounter the head end 22 of the pestle and be retained within the initial crushing area by the grooves 25 in the head of the pestle. As best seen in FIG. 1, the larger material will be reduced in size and due to the relative movement of the components and under the influence of gravity due to the inclination of the device, will move rearwardly along the pestle to the discharge end 24. FIGS. 8A and 8B illustrate the relative movement of the mortar and pestle. As the material moves rearward, the area between the pestle and the mortar reduces so that the material becomes crushed in increasingly finer mesh size and is finally discharged from the end of the pulverizer 10 at discharge 24. In some instances, the device may be used as a wet crusher in which case a suitable liquid such as water or the like would be introduced into the initial crushing chamber 14 through conduit 35. As mentioned above, the roll and axial movement of the pestle should be controlled to prevent "bounce" and feed rates regulated to prevent lift of the pestle within the mortar.

FIG. 4 shows an alternate embodiment of the crusher head. In this embodiment the head 60 is not smoothly tapered but is provided with a series of steps 62 which serves to engage and retain the material to be crushed in the initial crushing area. Step 65 is preferably tapered as shown.

FIGS. 5 and 6 show an alternate embodiment of the pestle which is generally designated by numeral 70. In this embodiment, the pestle is generally triangular in cross section and having a rounded lower edge 72 along which crushing occurs. The opposite sides 73 and 74 of the pestle 70 are substantially flat. This type of pestle has particular application when material is fed into the mortar transversely at the front end of the mortar.

FIG. 7 shows still another form of the pestle. In this form the cross section of the pestle 80 is circular with the pestle being tapered along the entire length from a larger diameter forward end 81 to a smaller diameter 83 at the exit end. The larger end is necessary to crush the larger pieces of rock. The lower, or exit end 83 does not have to be as large as the rock and material particles are of reduced size at this end.

In carrying out the method, material to be crushed is introduced into the crusher between the pestle and rocking mortar. The crushing operation can be controlled by the following or a combination of the following:

(1) Adjusting the angle of inclination of the mortar and pestle. The greater the angle of inclination, the coarser the substance at discharge. Conversely, the less the degree of inclination, the finer the material at discharge.

(2) Controlling the rate of flow of gas or liquid introduced into the crushing chamber. Higher flow rates tend to increase the resulting particle size while particle size will decrease with reduced flow rates.

(3) Regulating the weight of the pestle. The lighter the weight of the pestle, the coarser the material at discharge. The heavier the pestle, the finer the material at exit.

(4) The length of the mortar and pestle. The longer the unit (or units if in series) the finer the resulting discharge will be.

(5) Number of cycles. The speed and number of rocking cycles of the mortar and pestle will also directly effect the particle size at discharge. Higher speeds and increased cycle will result in finer mesh discharge.

(6) Sliding the mortar and pestle axially. By inducing an axially sliding motion, in addition to the rocking motion, will cause further particle size reduction.

It will be obvious to those skilled in the art to make various changes, alterations and modifications to the present invention. To the extent these changes, alterations and modifications do not depart from the spirit and scope of the appended claims, they are intended to be encompassed therein.

We claim:

1. An apparatus for crushing and/or pulverizing materials comprising:

(a) a generally cylindrical elongate mortar member defining an interior crushing chamber having an inlet and a discharge;

(b) an elongate pestle within said chamber secured therein independent of said mortar, said pestle being provided with a head end adjacent the said inlet which diverges generally outwardly from the inlet end towards the discharge end, said head end further being provided with grooves therein; and (c) means for imparting a rocking motion to said mortar.

2. The apparatus of claim 1 wherein the head end defines a plurality of "steps" increasing in diameter from the inlet end toward the outlet end.

3. The apparatus of claim 1 wherein said pestle is generally cylindrical.

4. The apparatus of claim 1 wherein said pestle is generally triangular in cross-section.

5. The apparatus of claim 1 wherein said pestle is generally circular in cross section and decreases in diameter from the head end toward the discharge end.

6. The apparatus of claim 1 further including conduit means for delivering a fluid into the crushing chamber.

7. The apparatus of claim 1 wherein said means for imparting a rocking motion to said mortar includes a cradle for supporting said mortar and eccentric drive means for imparting motion to said cradle and mortar.

8. The apparatus of claim 1 wherein said mortar includes an extension ahead of said pestle defining a feed trough for receiving material.

9. An apparatus for crushing and/or pulverizing materials comprising:

(a) a generally cylindrical elongate mortar member defining an interior crushing chamber having an inlet and a discharge;

(b) an elongate pestle within said chamber secured therein independent of said mortar;

(c) means for imparting a rocking motion to said mortar; and (d) adjustable table means supporting said mortar and pestle for establishing a predetermined inclination from the horizontal of said mortar and pestle whereby material will flow under the influence of gravity from the inlet to the outlet as a rocking motion is imparted.

10. A method for crushing material comprising:

(a) introducing the material to be crushed into a generally cylindrical mortar having an inlet and a discharge end containing a pestle moveable therein independent of said mortar;

(b) imparting a rocking motion to said mortar; and (c) controlling the degree of inclination of said mortar and pestle to cause material to flow from said inlet to said discharge.

11. Th method of claim 10 further including the step of introducing a liquid or gas into said mortar.

12. The method of claim 10 further including the step of moving the pestle axially within the mortar.

* * * * *